US005750295A

United States Patent [19]

Kim et al.

[11] Patent Number: 5,750,295

[45] Date of Patent: May 12, 1998

[54] METHOD FOR SCREENING A PANEL OF A COLOR CRT

[75] Inventors: Choong-lak Kim, Daejeon-si; Jong-ho Cho, Kyungki-do, both of Rep. of Korea

[73] Assignee: Samsung Display Devices Co., Ltd., Kyungki-do, Rep. of Korea

[21] Appl. No.: 800,289

[22] Filed: Feb. 13, 1997

[30] Foreign Application Priority Data

Nov. 19, 1996 [KR] Rep. of Korea ..... 96-55270

[51] Int. Cl.[6] ..... G03G 13/00; G03C 5/00

[52] U.S. Cl. ..... 430/25; 430/23; 430/28; 430/29; 430/31

[58] Field of Search ..... 430/23, 25, 28, 430/29, 31

[56] References Cited

U.S. PATENT DOCUMENTS

| | | | |
|---|---|---|---|
| 5,340,674 | 8/1994 | Moscony et al. | 430/29 |
| 5,391,444 | 2/1995 | Cuppen | 430/28 |
| 5,474,866 | 12/1995 | Rit et al. | 430/25 |
| 5,554,468 | 9/1996 | Datta et al. | 430/28 |

*Primary Examiner*—Roland Martin

*Attorney, Agent, or Firm*—Christie, Parker & Hale, LLP

[57] ABSTRACT

A light fixing layer is deposited on the panel during the screening process of a panel. The light fixing layer can be softened when it is subjected to light so as to allow the phosphor layers to be fixed on the panel. That is, the light fixing layer shows adhesive characteristics when subjected to light. Therefore, after developing all phosphor layers on the panel, when the light is radiated to the light fixing layer, the light fixing layer is softened, thereby fixing the phosphor layers.

9 Claims, 3 Drawing Sheets

METHOD FOR SCREENING A PANEL OF A COLOR CRT

FIELD OF THE INVENTION

The present invention relates to a method for screening a panel of a color CRT and, more particularly, to a method for screening in which only one phosphor layer fixing process is required, thereby reducing the number of screening steps.

BACKGROUND OF THE INVENTION

Generally, a panel for CRTs is deposited with red(R), green(G), and blue(B) phosphors constituting a phosphor layer of the panel. To divide the three phosphors and prevent color mixture, thereby increasing color definition, a black matrix is deposited between the phosphors.

Two methods for screening the panel are used including a wet-layer method using a slurry and a dry-layer method using an electrophotographic screening process.

The wet-layer method suffers the of a complicated manufacturing process and polluting the environment caused by the slurry used in the process. Therefore, in recent years, the dry-layer method using an electrophotographic screening process has been widely used to form the phosphor layer and the black matrix on the panel.

As shown in FIG. 3, the conventional electrophotographic screening process comprises the steps of cleaning the face panel P1, depositing conductive and photoconductive layers P2, charging the photoconductive layer P3, exposing the layer P4, developing the black matrix P5, fixing the black matrix P6, charging the photocondutive layer on which the black matrix is formed P7, exposing for a first phosphor (i.e., green phosphor) P8, developing the first phosphor P9, fixing the developed first phosphor P10, charging the photoconductive layer on which the black matrix is formed and the first phosphor is fixed P7, exposing for a second phosphor layer (i.e., blue phosphor) P8, developing the second phosphor P9, fixing the second phosphor P10, charging the photoconductive layer on which the black matrix is formed and the first and second phosphors are fixed P7, exposing for a third phosphor P8, developing the third phosphor P9, and fixing the third phosphor P10.

In steps P6 and P10 where each phosphor is fixed, chemicals or a heat-treatment process is used. That is, chemicals such as acetone, which can react with the photoconductive layer so as to soften thereof is used for fixing the phosphor, or the photoconductive layer is heated so as to be softened, thereby fixing the phosphors.

However, the conventional screening method has a drawback in that when chemicals are used, the phosphors may undergo a chemical reaction with the chemicals. In addition, since a fixing step is required for each phosphor, the screening process is complicated. Further, since the photoconductive layer is repeatedly softened for each fixing step, the photoconductive layer decays or becomes deformed, whereby the phosphor which will be developed afterward is developed irregularly.

SUMMARY OF THE INVENTION

Therefore, the present invention has been made in an effort to solve the above described problems of the conventional screening method.

It is an object of the present invention to provide a screening method of a panel for CRTs, which can reduce the number of overall steps by allowing the use of only one step when fixing the phosphor.

It is another object of the present invention to provide a screening method of a panel which can fix phosphors on the panel such that they are securely attached thereon with relatively high attaching force.

The above objects are achieved by a light fixing layer which is deposited on the panel after depositing the black matrix in a predetermined pattern.

The light fixing layer can be softened when it is subjected to light so as to allow the phosphor layers to be fixed on the panel. That is, the light fixing layer shows adhesive characteristics when subjected to light. Therefore, after developing all phosphor layers on the panel, when light is radiated on the light fixing layer, the light fixing layer is softened, thereby fixing the phosphor layers.

Preferably, the light fixing layer is made of natural rubber, raw material containing rosin, acrylic rubber, or silicon adhesive.

It is also preferable to use an ultraviolet ray or visible ray as the light radiated in the step of fixing the phosphor layers.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

The following is the description of the preferred embodiments according to the present invention.

Figure 1:
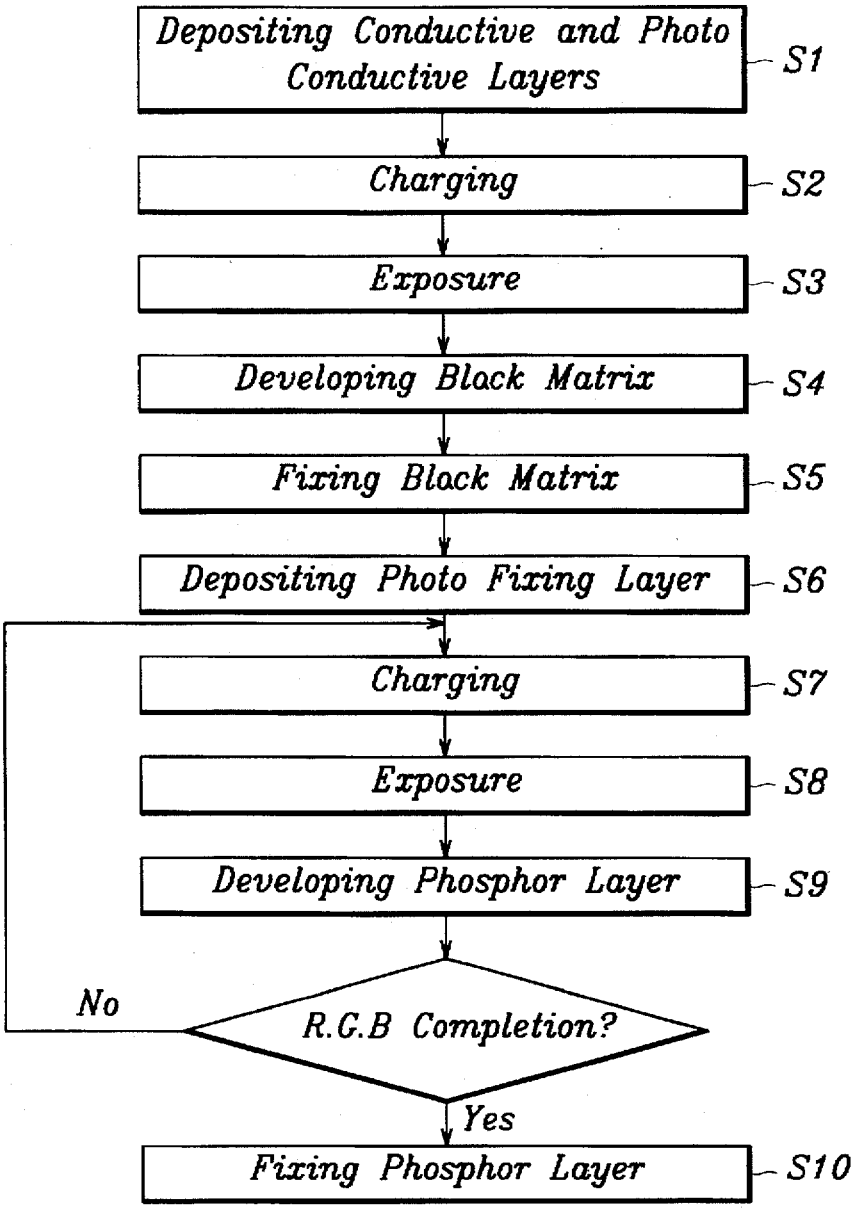
FIG. 1 is a flowchart illustrating a screening method of a panel according to a preferred embodiment of the present invention.
Figure 2:
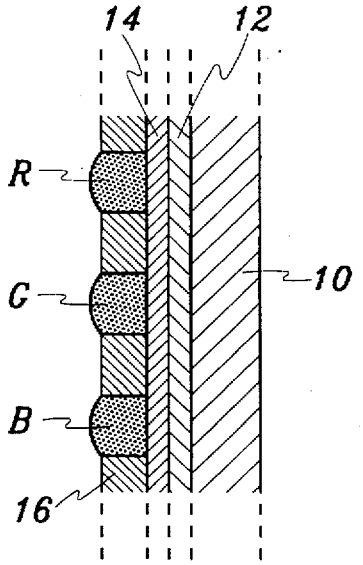
FIG. 2 is a sectional view illustrating a panel which is screened according to the present invention.
Figure 3:
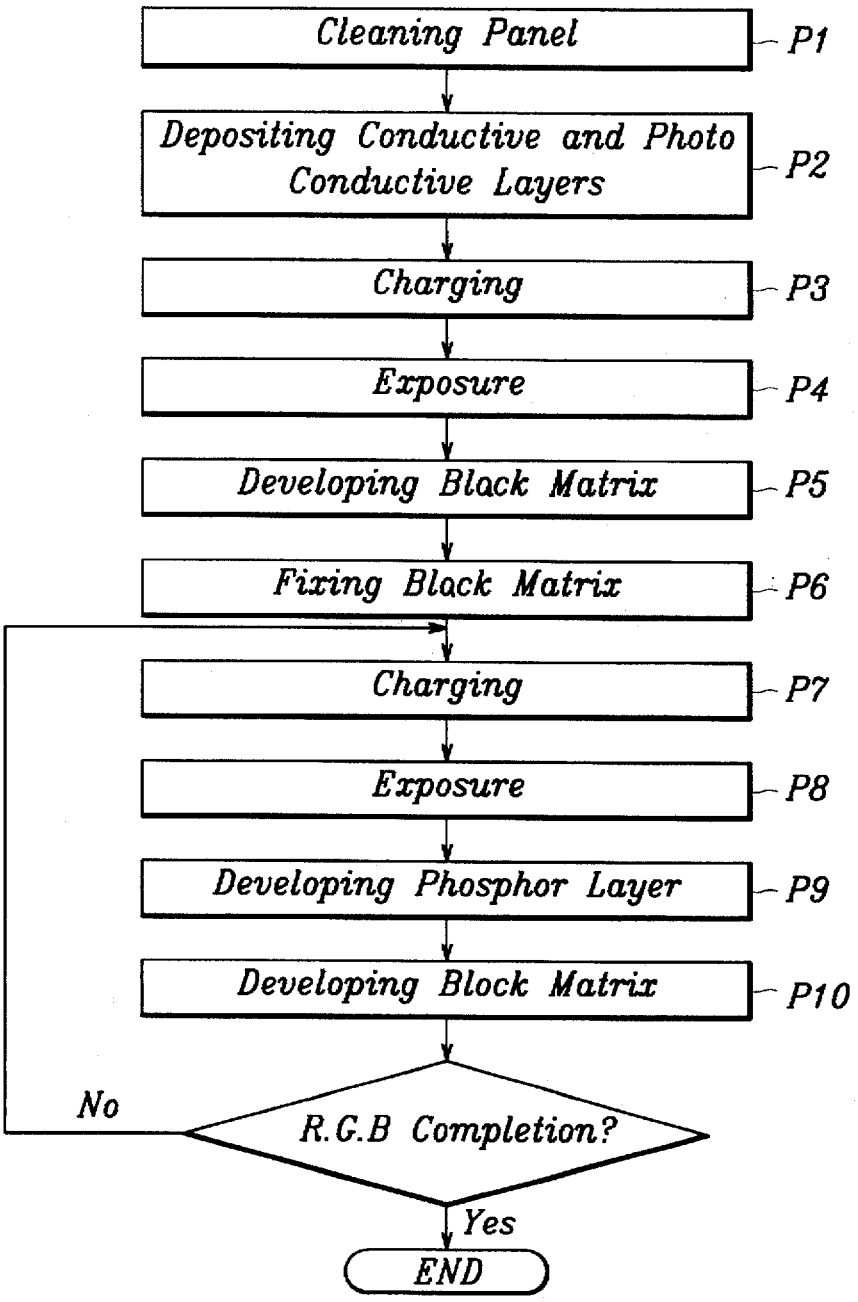
FIG. 3 is a flowchart illustrating a conventional screening method.

Referring first to FIGS. 1 and 2, there are respectively shown a flowchart illustrating the inventive screening method and a sectional view of a panel which is screened according to the inventive screening method.

As a first step S1, an inner surface of a screen panel 2 is coated with an organic conductive layer 12 then an organic photoconductive layer 14. As a second step S2, in order to form a black matrix, the organic photoconductive layer 12 is electrostatically charged to a suitable positive potential. In a third step S3, a shadow mask is disposed in front of the inner surface of the screen panel 10 at a predetermined distance therefrom and the organic photoconductive layer 12 is exposed to light radiated from a light source, such that a positive charge can be left on unexposed areas, where the black matrix 16 will be deposited, of the organic photoconductive layer 12. In a fifth step S5, the black matrix material which is charged with the same or opposite potential as or to the surface potential of the panel is sprayed on the panel and is then fixed.

After depositing the black matrix 16 in a predetermined pattern, the phosphor layer can be deposited on the inner surface of the panel, on which the black matrix is deposited, according to the following steps.

That is, in a sixth step S6, a light fixing layer which is made of a material showing adhesive characteristics when subjected to light is formed on the organic photoconductive layer 14 on which the black matrix is formed. The panel where the organic photoconductive layer and the black matrix are deposited is electrostatically charged to a suitable potential in a seventh step S7. As an eighth step S8, the charged panel is exposed to light so that surface potential can be remained in a predetermined pattern by using a shadow mask. First phosphor particles (i.e., red phosphor particles) which are charged to the same or opposite potential as or to that of the remaining surface potential is developed on the panel S9, thereby forming the first phosphor layer. Steps S7 through S9 are repeated for forming the second and third phosphor layers (i.e., green and blue phosphor layers). Finally, as a tenth step, the phosphor layers are fixed by radiating light to the light fixing layer which shows adhesive characteristics when exposed to light.

Preferably, the light fixing layer is made of natural rubber, raw material containing rosin, acrylic rubber, or silicon adhesive.

It is also preferable to use an ultraviolet ray or visible ray as the light radiated in the step of fixing the phosphor layers.

In the screening method of the panel as described above, since the light fixing layer is softened by the light radiated in the exposing step S8, the adhesive force of the phosphor layer can be improved. In addition, since the fixing step is performed in a single step after developing all phosphor layers, the number of screening steps are reduced.

While this invention has been described in connection with what is presently considered to be the most practical and preferred embodiment, it is to be understood that the invention is not limited to the disclosed embodiments, but, on the contrary, is intended to cover various modifications and equivalent methods included within the spirit and scope of the appended claims.

What is claimed is:

1. A method for screening a panel for a color cathode ray tube, said panel having an organic conductive formed thereon, and an organic Photoconductive layer formed on the organic conductive layer, said method comprising the steps of:

developing a black matrix on the organic photoconductive layer of the panel in a predetermined pattern;

fixing the black matrix developed on the organic photoconductive layer of the panel;

forming a light fixing layer on the panel, said light fixing layer having adhesive characteristics when subjected to light;

charging the panel to a potential;

exposing a portion of the charged panel to light so that the potential on the panel can be maintained in a predetermined pattern;

developing first phosphor particles having a same or opposite potential as the remaining potential on the panel, thereby forming the first phosphor layer;

repeating the charging, exposing and developing steps for at least second and third phosphor layers; and radiating light to the light fixing layer so that the light fixing layer has adhesive characteristics, thereby fixing the developed phosphor layers.

2. A method for screening a panel according to claim 1 wherein the light fixing layer comprises natural rubber having rosin.

3. A method for screening a panel according to claim 1 wherein the light fixing layer comprises acrylic rubber.

4. A method for screening a panel according to claim 1 wherein the light fixing layer comprises silicon adhesive.

5. A method for screening a panel according to claim 1 wherein the light radiated in the step of fixing the phosphor layer is an ultraviolet ray or visible ray.

6. A method for forming a phosphor layer on a panel of a color cathode ray tube, said panel having an organic conductive layer formed thereon, an organic photoconductive layer formed on the organic conductive layer, and a black matrix developed and fixed on the photoconductive layer in a predetermined pattern, the method comprising the steps of:

(a) forming a light fixing layer on the panel, said light fixing layer having adhesive characteristics when subjected to light;

(b) charging the panel to a potential;

(c) exposing a portion of the charged panel to light so that the potential on the panel is maintained in a predetermined pattern;

(d) developing phosphor particles having a same or opposite potential to the remaining potential on the panel;

(e) repeating steps (b) to (d) for second and third phosphor particles; and (f) subjecting the light fixing layer to light for fixing the developed phosphor particles to the panel.

7. The method of claim 6 wherein the light fixing layer comprises a compound of natural rubber and a material selected from the group consisting of rosin, acrylic rubber, and silicon adhesive.

8. The method of claim 6 wherein the light in the step (e) is an ultraviolet ray or visible ray.

9. A method for applying a plurality of different color phosphor particles to a panel of a color cathode ray tube, said panel having an organic conductive layer formed thereon, and an organic photoconductive layer formed on the organic conductive layer, the method comprising the steps of:

(a) developing a black matrix on the organic photoconductive layer of the panel in a predetermined pattern;

(b) fixing the black matrix developed on the organic photoconductive layer of the panel;

(c) forming a light fixing layer on the panel, said light fixing layer having adhesive characteristics when subjected to light;

(d) charging the panel to a potential;

(e) exposing a portion of the charged panel to light so that the surface potential on the panel can be maintained in a predetermined pattern;

(f) developing one of the different color phosphor particles, said one of the different color phosphor particles having a same or opposite potential to the remaining potential on the panel;

(g) repeating steps (d) to (f) until each one of the plurality of different color phosphor particles are developed; and (h) subjecting the light fixing layer to light for fixing the developed phosphor particles to the panel.

* * * * *

UNITED STATES PATENT AND TRADEMARK OFFICE

CERTIFICATE OF CORRECTION

PATENT NO. : 5,750,295
DATED : May 12, 1998
INVENTOR(S) : Choong-lak Kim; Jong-ho Cho It is certified that error appears in the above-identified patent and that said Letters Patent is hereby corrected as shown below:

Column 1, line 20, after "suffers" delete "the of".
Column 2, lines 49, 53 and 58, replace "organic photoconductive layer 12" with "organic photoconductive layer 14" (all occurrences).
Column 3, line 6, replace "be remained" with "remain".
Column 3, line 38, change "Photoconductive" to -- photoconductive --.

Signed and Sealed this

Twentieth Day of July, 1999

*Attest:*

*Attesting Officer*

Q. TODD DICKINSON

*Acting Commissioner of Patents and Trademarks*